US005267461A

United States Patent [19]

Eizen

[11] Patent Number: 5,267,461

[45] Date of Patent: * Dec. 7, 1993

[54] CYLINDER GUARD

[75] Inventor: Noach Eizen, Rishon Lezion, Israel

[73] Assignee: Mul-T-Lock Ltd., Yavne, Israel

[ * ] Notice: The portion of the term of this patent subsequent to Jan. 7, 2009 has been disclaimed.

[21] Appl. No.: 547,771

[22] Filed: Jul. 3, 1990

[30] Foreign Application Priority Data

Jan. 5, 1990 [IL] Israel ..... 92982

[51] Int. Cl.[5] ..... E05B 9/08

[52] U.S. Cl. ..... 70/451; 70/417; 70/418; 70/452

[58] Field of Search ..... 70/417, 451, 448, 418, 70/452

[56] References Cited

U.S. PATENT DOCUMENTS

| | | | |
|---|---|---|---|
| 4,316,371 | 2/1982 | Del Nero | 70/417 |
| 4,530,223 | 7/1985 | Oliver | 70/417 |
| 4,688,409 | 8/1987 | Oliver | 70/417 |

*Primary Examiner*—Robert L. Wolfe
*Attorney, Agent, or Firm*—Ladas & Parry

[57] ABSTRACT

A cylinder guard including a plurality of guard plates, at least one of which is formed with a plurality of non-rotatable bolt head seats and a plurality of bolts having heads non-rotatably seated in the non-rotatable bolt head seats and arranged for mounting the cylinder guard onto a door.

2 Claims, 3 Drawing Sheets

CYLINDER GUARD

FIELD OF THE INVENTION

The present invention relates generally to guard plates for cylinder locks.

BACKGROUND OF THE INVENTION

Various types of guards for key cylinders are known. The prior art is summarized in the Background of the Invention of U.S. Pat. No. 4,530,223. That patent describes a guard for a key cylinder employing a flat thick steel protective plate and a plurality of studs welded thereto. The guard described in U.S. Pat. No. 4,530,223 is relatively expensive to manufacture.

SUMMARY OF THE INVENTION

The present invention seeks to provide an improved cylinder guard which has several advantages over the prior art, both in terms of ease and cost of manufacture and in terms of ease of installation.

There is thus provided in accordance with a preferred embodiment of the present invention a cylinder guard including a plurality of guard plates, at least one of which is formed with a plurality of non-rotatable bolt head seats and a plurality of bolts having heads non-rotatably seated in the non-rotatable bolt head seats and arranged for mounting the cylinder guard onto a door.

There is also provided in accordance with a preferred embodiment of the present invention a cylinder guard including a plurality of guard plates, at least one of which is bent to form at least one edge protective surface preventing prying apart of the guard plates.

There is additionally provided in accordance with a preferred embodiment of the present invention a cylinder guard including a plurality of guard plates, a plurality of bolts arranged for mounting the cylinder guard onto a door, an internally threaded sleeve threadingly engaging each of the bolts and a washer member, retained by each threaded sleeve against the door on a surface opposite to that onto which the guard is mounted.

In accordance with a preferred embodiment of the invention, there is also provided a locking screw arranged for threaded engagement with the threaded sleeve so as to tightly engage the bolt and to prevent disengagement thereof from the sleeve.

All of the above features may be combined in any suitable combination in accordance with the present invention.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
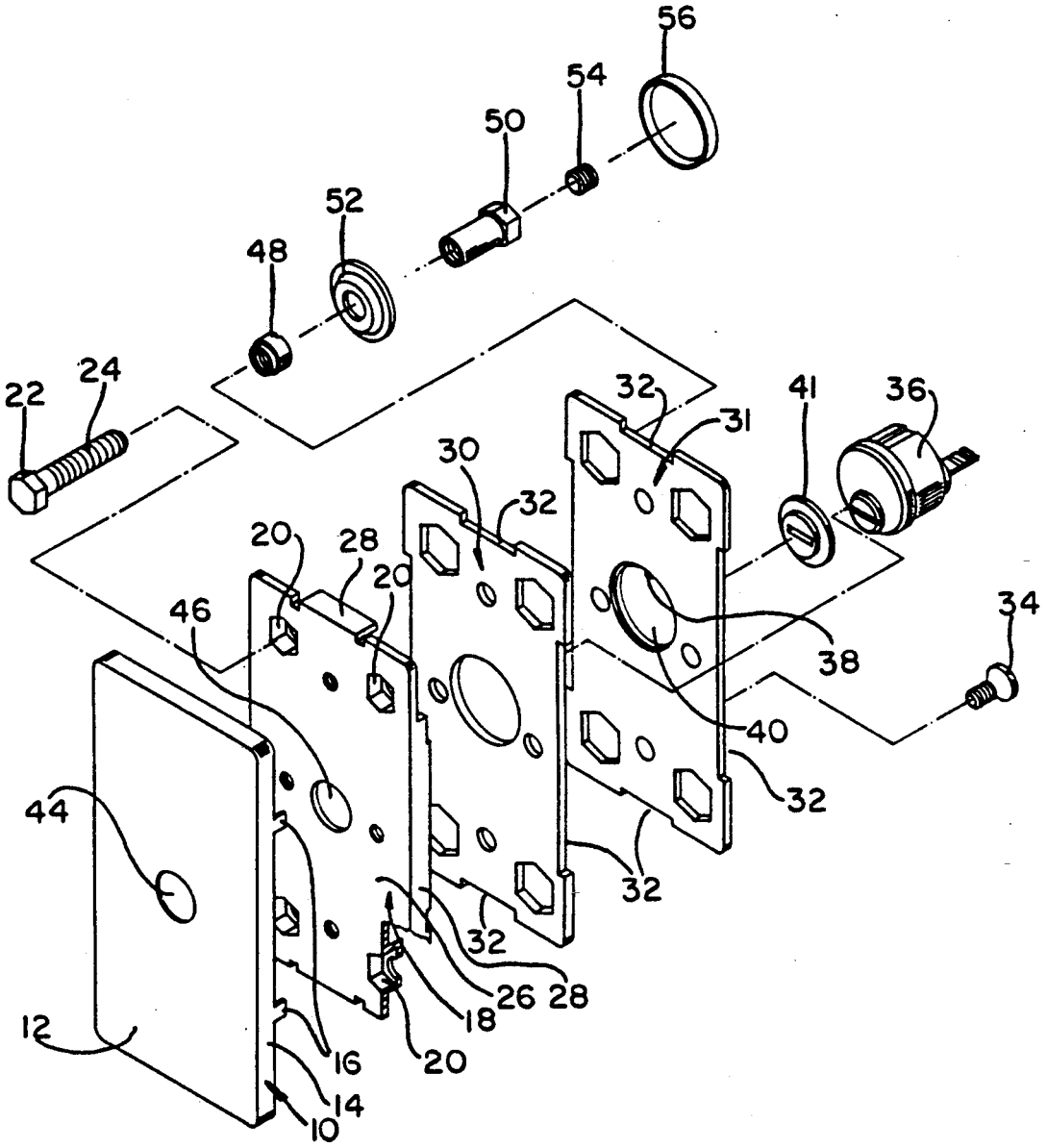
FIG. 1 is an exploded view illustration of a cylinder guard constructed and operative in accordance with a preferred embodiment of the present invention.
Figure 2:
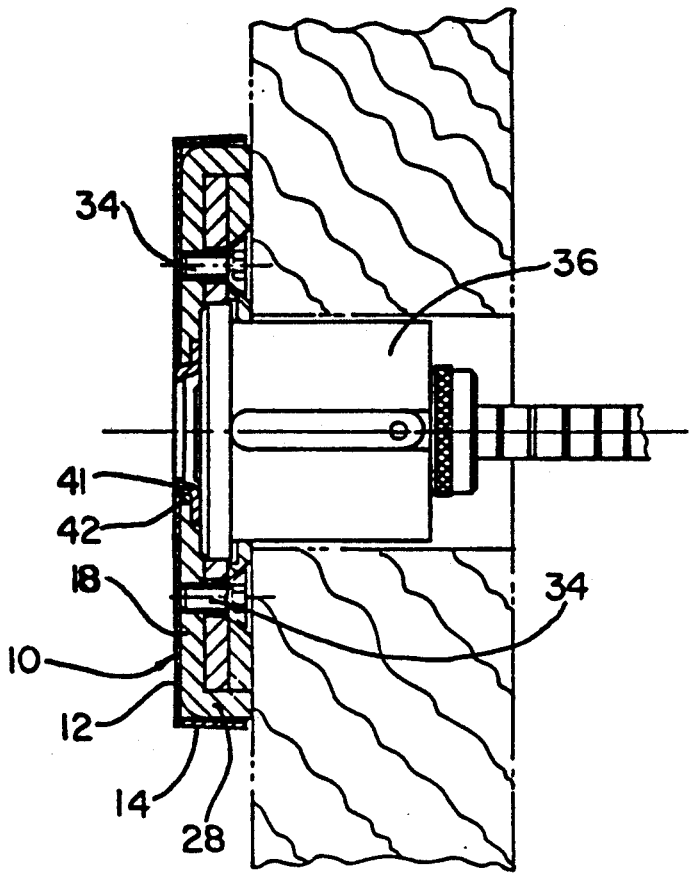
FIG. 2 is a sectional illustration showing mounting of the cylinder in the cylinder guard of FIG. 1.
Figure 3:
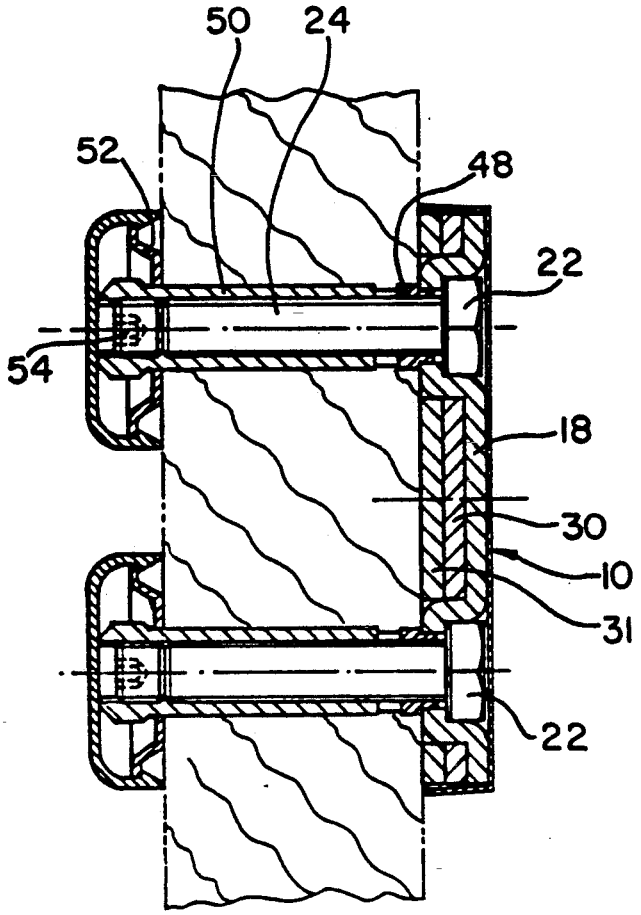
FIG. 3 is a sectional illustration showing mounting of the cylinder guard on a door in accordance with a preferred embodiment of the invention.

Reference is now made to FIGS. 1, 2 and 3, which illustrate the construction and mounting of a cylinder guard constructed and operative in accordance with a preferred embodiment of the present invention.

The cylinder guard preferably comprises a decorative cover plate 10 including a planar surface 12 and a peripheral edge surface 14, as well as mounting tabs 16. Disposed behind the decorative cover plate 10 is a first reinforcement plate 18, typically formed of steel plate.

In accordance with a preferred embodiment of the present invention, the first reinforcement plate 18 is molded or preferably stamped to define a plurality of non-rotatable seating sockets 20, preferably disposed adjacent the four corners of the reinforcement plate. The sockets 20 are preferably configured to have a non-circular configuration, such as that of a polygon, for receiving a similarly shaped head 22 of a hardened mounting bolt 24.

Further in accordance with a preferred embodiment of the present invention, the first reinforcement plate 18 is formed with a planar surface 26 and a plurality of side protective surfaces 28, extending generally perpendicularly thereto for preventing prying apart of the various reinforcement plates which form part of the cylinder guard.

Disposed behind first reinforcement plate 18 are preferably two additional reinforcement plates 30 and 31, which may be identical or nearly identical. They are provided with edge recesses 32 for receiving side protective surfaces 28 of the first reinforcement plate 18.

Plate 18 and plates 30 and 31 are typically held together by means of a plurality of screws 34 which threadably engage the first reinforcement plate 18.

A cylinder 36 is retained against rotation by means of a key 38 defined in a cylinder aperture 40 formed in plate 31. A rotatable keyway reinforcement element 41 is seated in a recess 42 formed in a rear facing surface of the first reinforcement plate 18, as seen in FIG. 2. Key access therethrough to the cylinder is provided via key access apertures 44 and 46 formed in the cover member 10 and the first reinforcement plate 18 respectively.

Reference is made particularly to FIGS. 1 and 3, which illustrate mounting of the cylinder guard onto a door. It is seen that bolts 24, the heads 22 of which are non-rotatably seated in sockets 20 extend through the door. An internally threaded short sleeve 48 threadably engages each bolt 24 behind plate 31, thus retaining plates 18, 30 and 31 in tight engagement.

A principal internally threaded sleeve 50 threadably engages each bolt 24 and tightly retains a cap washer 52 against one surface of the door and the cylinder guard onto the opposite surface thereof. Loosening of the sleeve 50 from the bolt 24 is prevented by threaded engagement of a screw 54 internally of sleeve 50 in abutting engagement with a facing end of bolt 24. A decorative cap member 56 is provided over each cap washer 52.

It will be appreciated by persons skilled in the art that the present invention is not limited by what has been particularly shown and described hereinabove. Rather the scope of the present invention is defined only by the claims which follow:

I claim:

1. A cylinder guard comprising:

an outer cover;

a plurality of guard plates, at least one of which is formed with a plurality of nonrotatable bolt head seats, said plurality of guard plates being held together only by means of screws at least one of said guard plates being bent to form at least one edge protective surface preventing prying apart of the guard plates;

a plurality of bolts having heads nonrotatably seated in the non-rotatable bolt head seats and arranged for mounting the guard plates onto a door.

2. A cylinder guard according to claim 1 and also comprising:

an internally threaded sleeve threadingly engaging each of the bolts and a washer member, retained by each threaded sleeve against the door on a surface opposite to that onto which the guard is mounted.

* * * * *